United States Patent [19]

Test

[11] Patent Number: 4,558,193

[45] Date of Patent: Dec. 10, 1985

[54] SWITCH LOCK

[75] Inventor: Dan Test, Winchester, Mass.

[73] Assignee: C & K Components, Inc., Newton, Mass.

[21] Appl. No.: 634,192

[22] Filed: Jul. 27, 1984

Related U.S. Application Data

[63] Continuation of Ser. No. 480,893, Mar. 31, 1983, abandoned.

[51] Int. Cl.[4] ..... H01H 9/28

[52] U.S. Cl. ..... 200/43.05; 70/DIG. 30; 200/277; 200/11 R

[58] Field of Search ..... 200/44, 277, 334, 11 R, 200/11 T, 11 G; 70/379 R, 369, 451, 449, DIG. 30

[56] References Cited

U.S. PATENT DOCUMENTS

| | | | |
|---|---|---|---|
| 2,546,744 | 3/1951 | Hasselbaum | 200/44 X |
| 2,695,932 | 11/1954 | Jacobi | 200/44 |
| 2,778,891 | 1/1957 | Jacobi | 200/44 |
| 3,310,642 | 3/1967 | Zeller | 200/44 |
| 3,339,036 | 8/1967 | Canaday | 200/44 |
| 3,346,707 | 10/1967 | Boek et al. | 200/277 X |
| 3,639,708 | 1/1972 | Wolniak et al. | 200/44 |
| 3,676,617 | 7/1972 | Miller | 200/44 |
| 3,770,916 | 11/1973 | Cardwell | 200/44 |
| 4,158,057 | 1/1980 | Sonnenberg | 200/44 X |
| 4,227,056 | 10/1980 | Johnston et al. | 200/44 |
| 4,258,237 | 3/1981 | Beck | 200/11 J |
| 4,292,483 | 9/1981 | Roytberg | 200/44 X |

FOREIGN PATENT DOCUMENTS

| | | | |
|---|---|---|---|
| 0066826 | 12/1982 | European Pat. Off. | 200/44 |

*Primary Examiner*—Stephen Marcus
*Assistant Examiner*—Ernest G. Cusick

[57] ABSTRACT

This invention is directed at a switch lock comprising a top plate positioned between the lock portion and the switch portion. The top plate includes a recess which provides stop means for the switch lock.

7 Claims, 7 Drawing Figures

SWITCH LOCK

BACKGROUND OF THE INVENTION

This is a continuation of application Ser. No. 480,893 filed 3/31/83, now abandoned.

This invention relates generally to a lockable, rotary electric switch and more specifically to a tumbler type lockable electric switch for use with home television sets and the like.

Cylinder locks are known in which a rotary switch is built directly onto a cylinder lock and is used for various purposes, for example, on-off switching of electrical circuits which can only be activated by insertion of a key which fits the lock. The lock can also be changed to permit removal of the key in the three and twelve o'clock on positions.

SUMMARY OF THE INVENTION

The invention disclosed herein comprises a switchlock for use with a cable TV system. In many cable TV systems a control box is electrically interposed between the cable TV system and the home viewing system.

The system coming into the control box is scrambled and the control box needs to be activated to unscramble the system so that it can be succesfully utilized in the standard home viewing system. Some programs that are available on cable are unsuitable for viewing by children and the use of the inventor's switchlock prevents unauthorized access to the cable system. When the inventor's lockswitch is mounted on the control box, a parent can monitor use of the cable system with the key, and if a parent does not want a child to view a program on the cable system he need only remove and retain the key.

The switch lock of the instant invention includes a top plate having a recess formed therein which provides a stop means.

BRIEF DESCRIPTION OF THE DRAWINGS

Further details are explained below with the help of the examples illustrated in the attached drawings in which.

DESCRIPTION OF THE PREFERRED EMBODIMENT(S)

Figure 1:
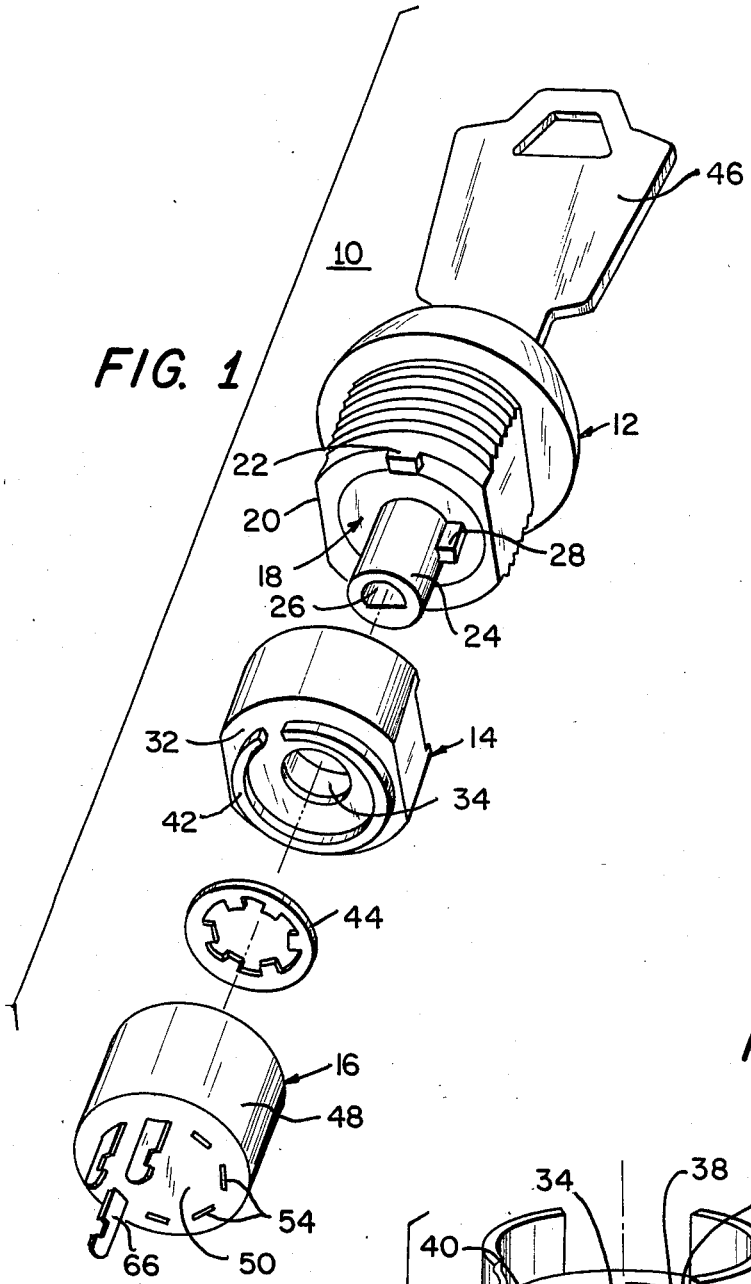
FIG. 1 is an isometric view of the switch lock according to the present invention.
Figure 2:
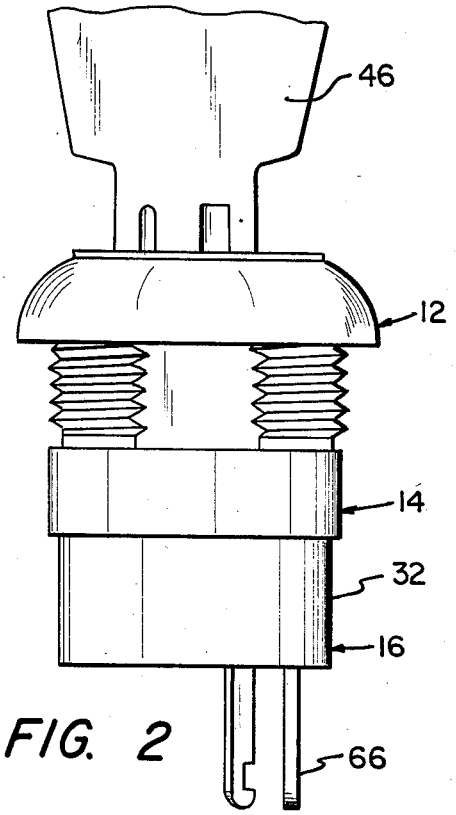
FIG. 2 is a side elevational view of the switch lock shown in FIG. 1.
Figure 3:
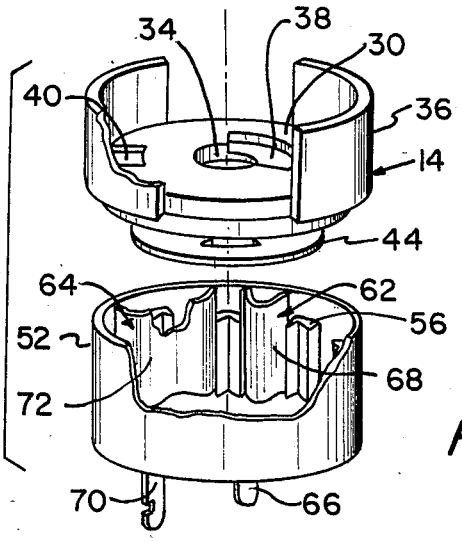
FIG. 3 is an isometric view of the top plate and switch of the switch lock shown in FIG. 1.
Figure 4:
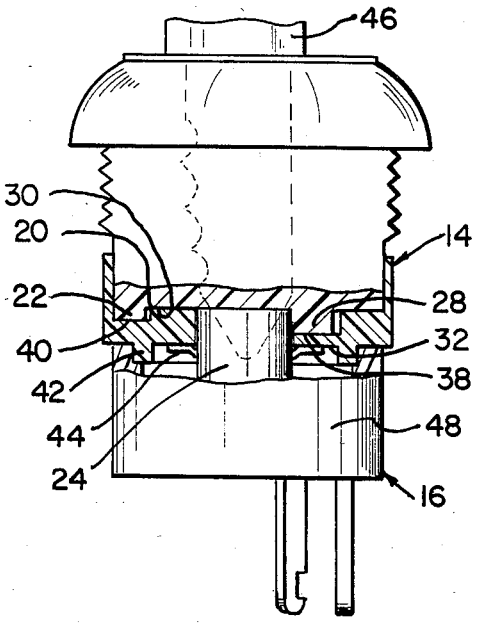
FIG. 4 is a side elevational view, with a portion broken away, showing the top plate assembled with the switch of the switch lock shown in FIG. 1.
Figure 5:
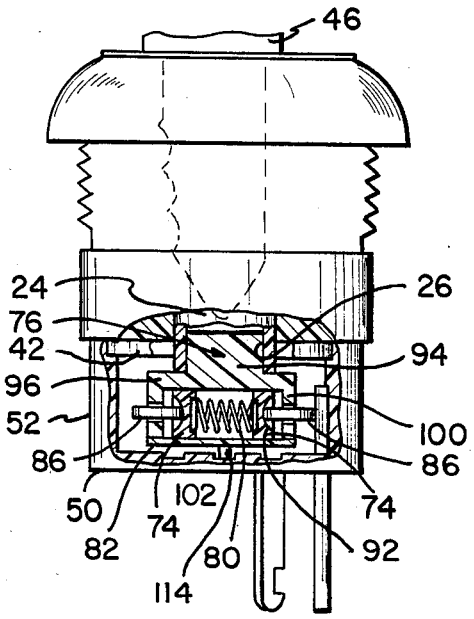
FIG. 5 is a side elevational view with a portion broken away showing the actuator assembly of the switch lock shown in FIG. 1.
Figure 6:
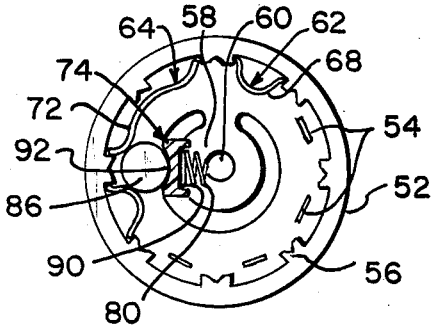
FIG. 6 is a sectional view showing a contact, contact spring and moveable contact of the switch lock shown in FIG. 1.
Figure 7:
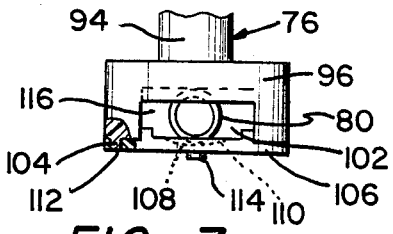
FIG. 7 is a side elevational view showing actuator and stop plate assembled of the switch lock shown in FIG. 1.

There is shown in the drawings a switch lock 10 comprising a lock 12, a top plate 14 and a switch 16.

The lock 12 may be a conventional cylinder lock including a zinc die-cast activating means or lock cylinder 18 which is axially mounted in a steel shell or cylinder sleeve 20. The lock cylinder sleeve 20 has a longitudinal bore within which the lock cylinder 18 with its mounted tumblers are positioned. The external surface of the lock cylinder sleeve 20 is threaded and a rectangular stud 22 extends from the end of the sleeve 20 adjacent the opening through which an integral, axially mounted shaft 24 of the lock cylinder 18 extends. The shaft 24 is tubular in external configuration, has a free terminal end and a D shaped bore 26, which opens at the terminal end. An integral, rectangular projection 28 extends longitudinally from the external surface of the shaft 24 in close proximety to the horizontal plane at which the shaft 24 extends from within the lock cylinder sleeve 20. When an appropriate key 46 is engaged in the lock 12 and rotated, the lock cylinder 18 and its shaft 24 also rotate.

The top plate 14, formed of an electrically insulating material, such as a glass filled polyester plastic, comprises an upper face or surface 30, a bottom face or lower surface 32 and a centrally located through opening 34. The upper face 30 has a pair of arced guide walls 36 extending upwardly from the periphery thereof. The guide walls 36 are in spaced, opposed relationship to each other. An arced recess 38 is formed in the upper face 30 opening into the opening 36. The arced recess 38, whose end walls act as stops may be formed with varying degrees of arc and may be positioned, where desired, on a circle circumscribing the opening 34. For example, 90 degrees from 12 o'clock to 3 o'clock, 90 degrees from 6 o'clock to 9 o'clock or 180 degrees from 9 o'clock to 3 o'clock. A rectangular notch 40 is provided in the upper face 30 adjacent a guide wall 36 and spaced from the recess 38. An engagement wall 42 extends from the lower face 32. The engagement wall 42 defines a substantially circular configuration, circumscribes the opening 34 in spaced relation and is spaced from the periphery of the lower face 32.

The top plate 14 is assembled with the lock 12 by passing the shaft 24 of the lock cylinder 18 through the opening 34 until the stud 22 of the lock cylinder sleeve 20 is seated in the notch 40 and the projection 28 extending from the shaft 24 is positioned in the arced recess 38. A portion of the upper face 30 bears against the lock cylinder sleeve 20. A retainer ring 44 is press fitted around the terminal end of the shaft 24 to bear against the lower face 32 of the top plate 14 within the area defined by the engagement wall 42 holding the top plate in assembly with the lock 12. In this position the lock cylinder 18 and its shaft 24 with the attached retainer ring 44 may be rotated by a key 46 engaged in the lock 12. Obviously the projection 28 may move within the recess 38 while the top plate 14 is prevented from rotary motion by the engagement of the stud 22 with the notch 40.

The switch 16 has a housing 48 which may be formed of an insulating material such as bakelite, nylon, a glass filled polyester plastic or the like and comprises a circular base portion 50 having an wall 52 extending upwardly from the periphery and at right angles to the horizontal plane thereof. A series of rectangular slots 54 are formed through the base portion 50 spaced from each other and from the wall 52 defining a circular configuration. A series of spaced ribs 56 each having a V shaped notch formed in its facing surface extends upwardly from the base portion 50, integral with the wall 52 and positioned to the rear of the space between the slots 54. An integral circular platform 58 is centrally positioned on the base portion 50 and includes an axially located blind aperture 60.

The switch 16 includes short fixed terminals 62 and long fixed terminals 64. Each of the short fixed terminals 62 comprises a first shank portion 66 having an arced first contact portion 68 integral with a terminal end thereof and extending at right angles to the horizontal plane thereof. The radius of the arc of the first contact portion being 0.078". It should be noted that the switch 16 could have only short fixed terminals if 45 degree indexing angles were required. The use of the short and long fixed terminals provides 90 degree indexing in the embodiment described herein.

Each of the long fixed terminals 64 comprises a second shank portion 70 having an arced second contact portion 72 integral with a terminal end thereof and extending at right angles to the horizontal plane thereof. The radius of the arc of the second contact portion being 0.207".

The switch 16 also includes two spring insulators 74, an actuator 76, a contact spring 80, a stop plate 82 and a disk like moveable contact 86.

Each of the spring insulators 74 comprises a body portion having a contact spring engagement portion 90 formed on one side thereof and and a cup shaped, moveable contact engagement portion 92 formed on the other.

The actuator 76 comprises a D shaped, rod like shaft engaging portion 94 having a contact assembly engagement portion 96 integral with a terminal end of and in right angle relation to the longitudinal thereof. The contact assembly engagement portion 96 includes a circular base element. The base element having a shallow depression, including an arced base, formed therein and having a pair of opposed peripheral wall portions 100 extending from the edge thereof away from the shaft engaging portion 94 defining a channel 102 therebetween. A guide post 104 extends in right angle relation from one of the pheripheral wall portions 100.

The stop plate 82 comprises a circular base section 106 having a first side and a second side. The first side includes a generally rectangular trough 108 having an arced bottom portion 110 and a through aperture 112. The second side of the stop plate 82 has a post portion 114 extending from the center thereof.

The switch 16 is assembled by inserting the first shank portion 66 of the short fixed terminals 62 and the second shank portions 70 of the long fixed terminals 64 through the open end of the housing 48 and through a group of a predetermined number of the slots 54 formed in the base portion 50. The free terminal ends of the first and second shank portions 66, 70 are thus positioned outside the housing 48 and the first and second contact portions 68, 72 are positioned within the housing 48 defining a circular path. The contact spring engagement portion 90 of one of the spring insulators or cups 74 is engaged to each of the free terminal ends of the contact spring 80 and this subassembly is positioned in the channel 102 of the actuator 76 and the stop plate 82 snap engages the actuator 76 by engaging its aperture 112 with the guide post 104. The contact assembly engaging portion 96 of the actuator 76 faces the trough 108 of the stop plate 82 with the subassembly of the spring cups 74 and contact spring 80 positioned therebetween. The surface of the contact assembly engagement portion 96, of the actuator 76, between the peripheral wall portions 100 and the wall defining the trough 108 of the stop plate 82 are spaced from each other defining a circumferential contact retainer space 116. The disk shaped moveable contact 86 is then slid into the contact retainer space 116 to bear against the moveable contact engagement portion 90 of one of the spring insulators 74. In this position, the moveable contact 86 is rather loosely held and may rotate within the confines of the contact retainer space 116. The subassembly of the actuator 76, contact spring 80 engaged by the spring insulators 74, moveable contact 86 and stop plate 82 is positioned in the housing 48 with the moveable contact bearing against one of the contact portions 68, 72 of the short or long fixed terminals 62, 64 or bearing against adjacent contact portions 68, 72. The post portion 114 of the stop plate 82 is positioned and rotatable within the blind aperture 60 of the housing 48 base portion 50.

The subassembly of the lock 12, top plate 14 and retainer ring 44 (keyplug subassembly) is assembled with the switch 16 by inserting the D shaped shaft engaging portion 94 of the actuator 76 into the D shaped bore 26 of the lock cylinder's 18 integral shaft 24 bringing the lower face 32 of the top plate 14 into abutting relation with the upper surface of the wall 52 of the housing 48. These two portions are then ultrasonically welded together completing the assembly. If desired other joining techniques such as adhesive bonding may be utilized.

As stated hereinbefore, the inventor's switchlock may be mounted on a cable TV system control box which is electrically interposed between the cable TV system and the home viewing system. A parent can, therefore, monitor use of the cable system with the swithlock key, and if a parent does not want a child to view a program on the cable system he need only remove and retain the key. The switch 16 is operated when an individual turns a key 118 that has been properly inserted in the lock 12. The key 118 rotates the lock cylinder 18 which, in turn, rotates the integral shaft 24 thereof. The projection 28 is thereby moved within the arced recess 38 of the top plate's 14 upper face 30 and simultaneously, the shaft engaging portion 94 of the actuator 76 is rotated through its engagement with the D shaped bore 26 of the integral shaft 24 thus rotating the subassembly of the actuator 76, the stop plate 82 and the associated moveable contact 86. The end walls of the arced recess 38 provides the stop means; thereby, determining the degree of rotation of the integral shaft 24 and the projection 28. The moveable contact 86 will, for example, roll over either a first contact portion 68 or a second contact portion 72 and comes to rest in the space between a first contact portion 68 and a second contact portion 72 making electrical contact between these two adjacent terminals.

What I claim is:

1. A lock actuated switch device comprising a key, a lock, a top plate and a switch, the lock having a shell the lock also having a key hole and an activating means, the activating means extending from the lock through the shell, having a first free end and having a longitudinal axis, the shell having a stud extending therefrom and a projection extending from the activating means in angular relation to the longitudinal axis, the key engageable in the key hole and adapted on movement to rotate the activating means, the top plate having an upper surface, a lower surface and a central through aperture, the upper surface having a notch and a recess formed therewith, the recess having at least one stop position, the activating means extending through the aperture in the top plate with the lock bearing against the upper surface of the top plate and at least a portion of the projection seated in the recess and the stud seated in the notch, the switch having an actuating means and the activating means engaging the actuating means whereby rotation of the key will actuate the switch.

2. A lock actuated switch device as set forth in claim 1 wherein the activating means is a shaft and the recess has an arcuate configuration.

3. A lock actuated switch device as set forth in claim 1 wherein the switch is a rotary switch.

4. A lock actuated switch device as set forth in claim 2 wherein the lock includes an end, the activating means extending from the end and the switch being a rotary switch.

5. A lock actuated switch device as set forth in claim 4 wherein the end of the lock having a stud extending therefrom, the stud in spaced, parallel relation to the activating means, the upper surface of the top plate having a slot formed therewith, the stud engageable within the slot thereby preventing rotation between the lock and the top plate.

6. A lock actuating switch device as set forth in claim 5 wherein the top plate is held in assembly with the lock by a retainer ring engaged on the terminal end of the activating means.

7. A lock actuated switch device as set forth in claim 1 further comprising a housing and the actuating means having at least two terminals and a moveable contact, each of the terminals including a shank portion having an end and an arced contact portion integral with the end, the terminals engaged to the housing and the contact portions positioned to engage the moveable contact.

* * * * *